US006895918B1

(12) United States Patent
Hiraga

(10) Patent No.: US 6,895,918 B1
(45) Date of Patent: May 24, 2005

(54) DECOMPRESSION DEVICE OF INTERNAL COMBUSTION ENGINE

(75) Inventor: Takashi Hiraga, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/742,587

(22) Filed: Dec. 19, 2003

(51) Int. Cl.[7] ..... F01L 13/08
(52) U.S. Cl. ..... 123/182.1; 123/90.17
(58) Field of Search ..... 123/182.1, 90.16, 123/90.17, 321, 322

(56) References Cited

U.S. PATENT DOCUMENTS 3,620,203 A * 11/1971 Harkness ..... 123/182.1

FOREIGN PATENT DOCUMENTS

JP 60040715 4/1985

* cited by examiner

*Primary Examiner*—Andrew M. Dolinar
(74) *Attorney, Agent, or Firm*—Alleman Hall McCoy Russell & Tuttle LLP

(57) ABSTRACT

A decompression device of an internal combustion engine which is arranged compactly with reduced number of parts is provided. Typically, the device comprises a push-up rod which is disposed on a circumference of a cam shaft of the engine, within a range in the circumferential direction corresponding to a compression stage of the engine, and which protrudes outwardly in the radial direction of the cam shaft with respect to a base face of an exhaust-side cam face. The push-up rod is supported movably in the cam shaft direction between a decompression operating position, at which the push-up rod is inserted into a width-wise range of a bottom face of an exhaust-side tappet and a decompression non-operating position, at which the push-up rod is retreated from the width-wise range of the bottom face. Moreover, in the case of a multi-cylinder internal combustion engine having two cam shafts, a common solenoid is interlocked with the push-up rods provided on both the cam shafts and, thus the single solenoid can decompress the cylinders.

11 Claims, 11 Drawing Sheets

PRIOR ART

DECOMPRESSION DEVICE OF INTERNAL COMBUSTION ENGINE

TECHNICAL FIELD

The present invention relates to a decompression device of an internal combustion engine, which can improve performance of the engine, for example, during start-up, by extracting compression pressure inside a combustion chamber at a compression stage of the engine.

BACKGROUND OF THE INVENTION

One type of conventional decompression device of an internal combustion engine is a centrifugal-weight type decompression device, such as is disclosed in Japanese Examined Patent Application Publication No. H02-25007. In this decompression device of centrifugal-weight type, as shown in FIG. 1, a plurality of centrifugal weights 103 and 104, which open outwardly in the radial direction of a cam shaft 101 by a centrifugal force, are swingably attached in an end portion of the cam shaft 101. The cam shaft 101 includes an exhaust-side cam face 110. One of the centrifugal weights 104 is provided with a decompression cam portion 105. Both the centrifugal weight 103 and 104 are biased in the radially inward direction by a spring (not shown).

When starting the engine, the decompression cam portion 105 pushes up an exhaust-side tappet 106 only by a predetermined distance away from a base face of the exhaust-side cam face 110 at a compression stage of the engine and, thus an exhaust valve (not shown) is opened to release/decompress a compression pressure inside a combustion chamber (not shown). When an engine speed reaches to a practical engine speed, the centrifugal weights 103 and 104 are swung and opened in the outward direction by the centrifugal force due to the rotation of the cam shaft 101 while resisting a biasing force of the spring. The decompression cam portion 105 then withdraws under the base face of the exhaust-side cam face 110 and, thus, a decompression action is terminated.

The following four conditions are known to occur in internal combustion engines having centrifugal-weight type decompression devices as discussed above. (1) Since an engine speed for operating the decompression (also referred to as "a decompression operating engine speed") is determined in accordance with a balance of the centrifugal force and the biasing force of the spring, both of which act on the centrifugal weights 103 and 104 and, therefore the decompression operating engine speed is uniquely determined by the original setup of the decompression device, it is difficult to change the decompression operating engine speed afterwards. If the decompression operating engine speed is desired to be changed, for example, the decompression device must once be disassembled and then the centrifugal weights 103 and 104 must be replaced with those of different weight, or the spring must be replaced with that of a different spring force. Therefore, the replacement takes up a large amount of time and is really troublesome.

In many cases, an engine speed for terminating the decompression (also referred to as "a decompression terminating engine speed") is typically set higher than an engine speed at which the engine is started by a starter motor and lower than an idling engine speed. However, when the idling engine speed is set close to an engine speed at the time of starting of the engine, the operating state of the decompression may continue during the idling after the starting of the engine, due to an existence of variations in the decompression operating engine speed caused by variations in an attachment position or a size of the centrifugal weights or a spring force when assembled.

Further, in the above centrifugal-weight type decompression device, the centrifugal weights 103 and 104 rotate in a vertical plane around the cam shaft 101, which is horizontally arranged. The centrifugal force varies while rotation with the influences of gravity as the centrifugal weights 103 and 104 pass lower and upper position along a rotating path thereof. Thus, it is difficult to set the decompression operating engine speed exactly at a desired value.

(3) Only one centrifugal-weight type decompression device is required for a single-cylinder internal combustion engine. However, if it is applied to an internal combustion engine in which each cylinder exists independently, such as a V-twin type internal combustion engine, centrifugal-weight type decompression devices must be provided to each cam shaft of each cylinder and, thus, the number of parts, weight, size, and so on of the internal combustion engine will increase.

(4) The centrifugal-weight type decompression device only allows a control based on the decompression operating engine speed which is preset when it is assembled, and it cannot perform a control depending on other engine speed conditions. That is, the device cannot function appropriately, for example, in the case where it is used at the time of a stop operation of an internal combustion engine and when a decompression is desired to be performed at an engine speed higher than the idling engine speed, or otherwise when a decompression is not desired to be performed until stop of the engine.

BRIEF SUMMARY OF THE INVENTION

The present invention addresses the above objectives and a scope of the present invention is to provide a decompression device of an internal combustion engine which can be arranged compactly and can extend conditions on which a decompression is activated.

The decompression device of the present invention comprises a push-up member and a drive mechanism. The push-up member is disposed on a circumference of a cam shaft of a valve system of the internal combustion engine, within a range in a circumferential direction corresponding to a compression stage of the engine. The push-up member protrudes outwardly in the radial direction of the cam shaft more than a base face of an exhaust-side cam face formed on the cam shaft, and the push-up member is movably supported in the cam shaft direction. In this application, the cam shaft direction includes a shaft center direction of the cam shaft as well as a longitudinal direction of the cam shaft. The drive mechanism moves the push-up member in the cam shaft direction between a decompression operating position in which the push-up member is within a width-wise range of a bottom face of an exhaust-side tappet which comes in contact with the exhaust-side cam face, and a decompression non-operating position at which the push-up member is retreated from the width-wise range.

With this configuration, the decompression device can be manufactured compactly with a simple structure. Further, the decompression device allows a much easier adjustment of a decompression operating engine speed compared to the conventional centrifugal-weight type. Further, the decompression device also allows an ON/OFF switching of the decompression device based on conditions other than an engine speed. The drive mechanism can be configured in various ways. However, if the drive mechanism is provided on one end side of the cam shaft, it can be more simple and compact.

Moreover, in the decompression device of the internal combustion engine according to the present invention, the drive mechanism may include a guide rod fitted in a shaft-center bore formed along a shaft center of the cam shaft, movably in the cam shaft direction; and a connecting member for connecting the guide rod and the push-up member moves integrally in the cam shaft direction, wherein the push-up member is moved in the cam shaft direction through the connecting member by moving the guide rod. In this case, since the guide rod which rotates together with the push-up member arranged on the circumference of the cam shaft is fitted in the shaft center bore, an operation of moving the guide rod from the outside can be performed smoothly.

Moreover, in the decompression device of the internal combustion engine according to the present invention, the drive mechanism may include an actuator interlocked with the guide rod to move the push-up member. In this case, it is possible to provide a linear actuator as the actuator, and to arrange an output shaft of this linear actuator so that it intersects perpendicularly with the cam shaft. If a solenoid is adopted as the linear actuator, it may be arranged so that its movable iron core may cross with the cam shaft at right angles. Thereby, a width of an internal combustion engine in the cam shaft direction can be reduced.

Moreover, the decompression device of the internal combustion engine according to the present invention may have a plurality of cylinders and each cylinder is provided with the push-up member on the cam shaft, respectively. In this case, the actuator is interlocked with each of the push-up members such that the single actuator may decompress the plurality of cylinders. With this configuration of multi-cylinder internal combustion engine, it is possible to reduce number of parts for the decompression device and, thereby, reduce size of the internal combustion engine.

Moreover, in the decompression device of the internal combustion engine according to the present invention, the drive mechanism may further comprise a biasing means for biasing the push-up member to move the push-up member to a decompression non-operating position, at which the push-up member is withdrawn from the width-wise range. In this case, the actuator moves the push-up member to a decompression operating position at which the push-up member is reached within the width-wise range of the exhaust-side tappet which comes in contact with the exhaust-side cam face, while resisting a biasing force of the biasing means, upon activation. The actuator also moves the push-up member to the decompression non-operating position, at which the push-up member is withdrawn from the width-wise range, upon non-activation. With this configuration, the actuator is utilized only when moving the push-up member to the decompression operating position and, upon non-activation of the actuator, the push-up member is automatically returned to the decompression non-operating position by the biasing force of the biasing means.

In the decompression device of the internal combustion engine according to the present invention, the drive mechanism may comprise an engine speed detector for detecting the speed of the engine; a memory for storing the decompression operating engine speed; and a controller. The controller moves the push-up member to the decompression operating position when the engine speed detected by the engine speed detector is lower than a decompression operating engine speed stored in the memory, and moves the push-up member to the decompression non-operating position when the engine speed detected by the engine speed detector is higher than the decompression operating engine speed. Therefore, it is possible to provide a decompression control based on the decompression operating engine speed stored in the memory.

Moreover, the drive mechanism may include a setting adjusting unit for adjusting a set value of the decompression operating engine speed stored in the memory. In this case, the decompression operating engine speed can be set arbitrarily.

The above and further objects and features of the invention will more fully be apparent from the following detailed description with accompanying drawings.

DETAILED DESCRIPTION OF THE INVENTION

The present invention will now be described in detail referring to the accompanying drawings illustrating the embodiment thereof.

Figure 1:
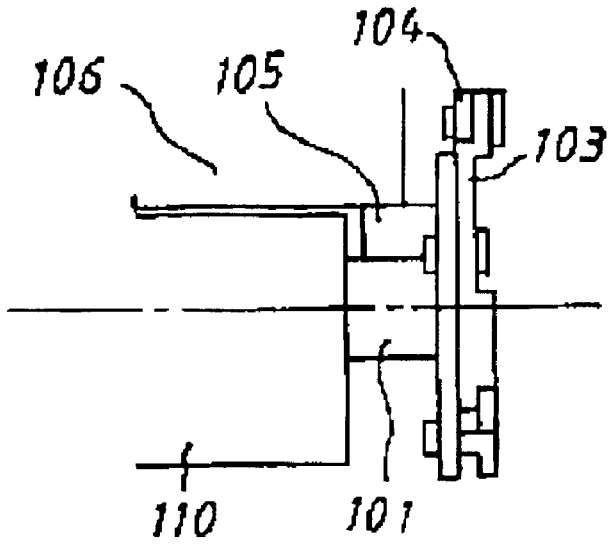
FIG. 1 is a side view of a conventional centrifugal-weight type decompression device.
Figure 2:
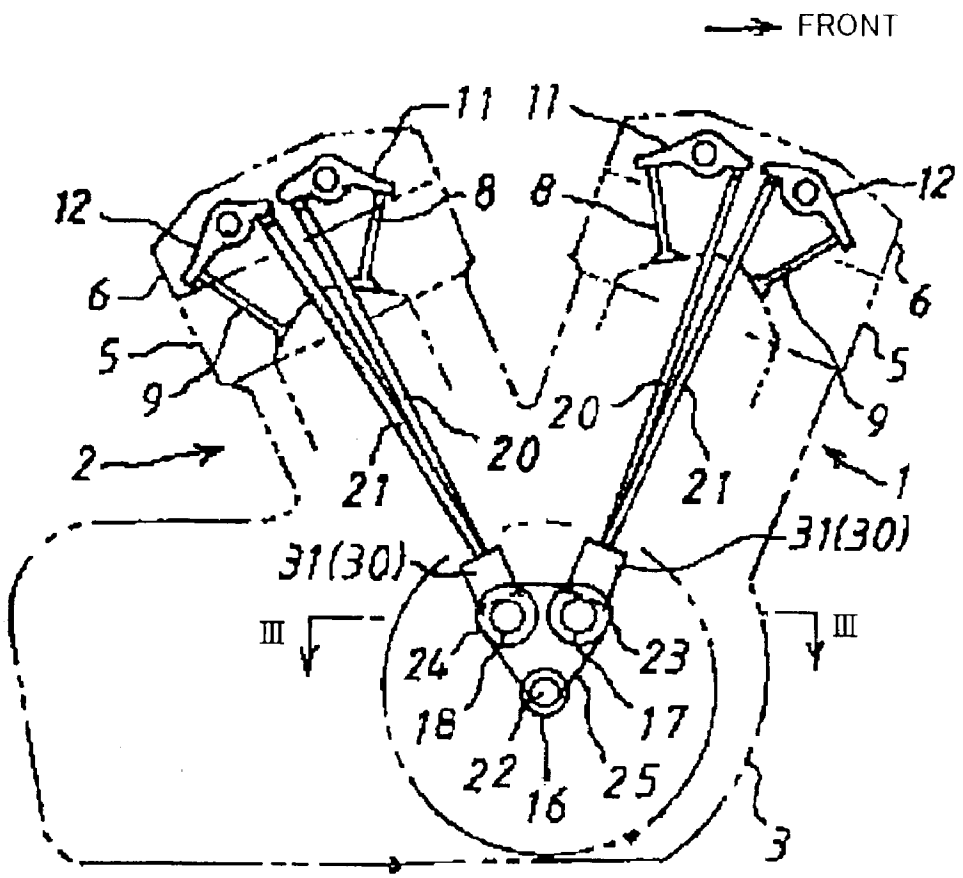
FIG. 2 is a schematic right side view of a V-twin type internal combustion engine and a valve mechanism thereof, to which the decompression device according to an embodiment of the present invention is applied.

ENTIRE INTERNAL COMBUSTION ENGINE AND VALVE MECHANISM THEREOF—FIG. 2 shows a schematic of a V-twin type internal combustion engine for motorcycles to which an embodiment of the present invention is applied, and its intake and exhaust valve mechanism. The internal combustion engine shown by the phantom lines in FIG. 2 typically comprises a first cylinder 1 (also referred to as "a front cylinder") tilted forward and a second cylinder 2 (also referred to as "a rear cylinder") tilted rearward, both arranged above a crank case 3. A cylinder head 5 of each of the cylinders 1 and 2 is provided with intake valve(s) 8 and exhaust valve(s) 9. Rocker arms 11 and 12 are arranged within a head cover 6, which covers the cylinder head 5, so as to engage with the intake valve(s) 8 and the exhaust valve(s) 9, respectively.

A cam shaft 17 for the first cylinder 1 and a cam shaft 18 for the second cylinder 2 are arranged within the crank case 3 above a crankshaft 16, in parallel with each other in the front-and-rear direction with a space formed therebetween. Chain sprockets 23 and 24 are fixed to a shaft end (see FIG. 3) of each of the cam shafts 17 and 18. The chain sprockets 23 and 24 are interlocked with a chain sprocket 22 on the crankshaft 16, through a cam drive chain 25 and, thus, a rotation of the crankshaft 16 is slowed down to one half and is then transmitted to each of the cam shafts 17 and 18.

The exhaust-side locker arms 12 of the cylinders 1 and 2 are interlocked with the cam shafts 17 and 18 for the first and second cylinders through exhaust-side push rods 21 and exhaust-side tappets 31, respectively. The intake-side locker arms 11 of the cylinders 1 and 2 are interlocked with the cam shafts 17 and 18 for the first and second cylinders through intake-side push rods 20 and intake-side tappets 30 (it is hiding behind the exhaust-side tappets 31 in FIG. 2), respectively.

Figure 3:
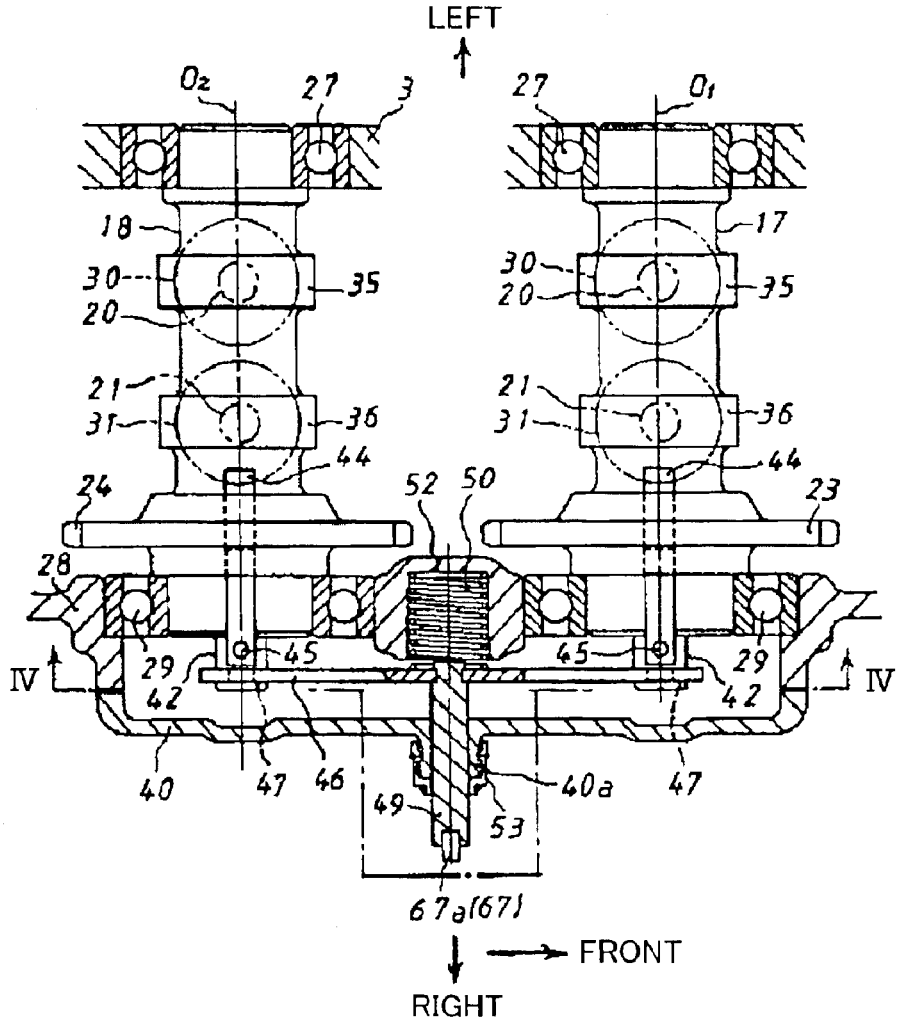
FIG. 3 is an enlarged cross-sectional view equivalent to an enlarged cross-section taken along the line III—III of FIG. 2.

FIG. 3 is an enlarged cross-sectional view taken along the line III—III of FIG. 2. In FIG. 3, end portions (left end portions in this embodiment) of the cam shafts 17 and 18 are supported by the crank case 3 through bearings 27, and opposing end portions (right end portions in this embodiment) are supported through bearings 29 by a cam shaft supporting case 28 fixed to the right end wall of the crank case 3. On each of the cam shafts 17 and 18, an exhaust-side cam face 36 and an intake-side cam face 35 are formed sequentially from right to left, respectively. The exhaust-side tappets 31 contact the exhaust-side cam faces 36, and the intake-side tappets 30 contact the intake-side cam faces 35. A cam shaft cover 40, which covers the right end portion of both the cam shafts 17 and 18, is fastened to the right end face of the cam shaft supporting case 28.

Figure 4:
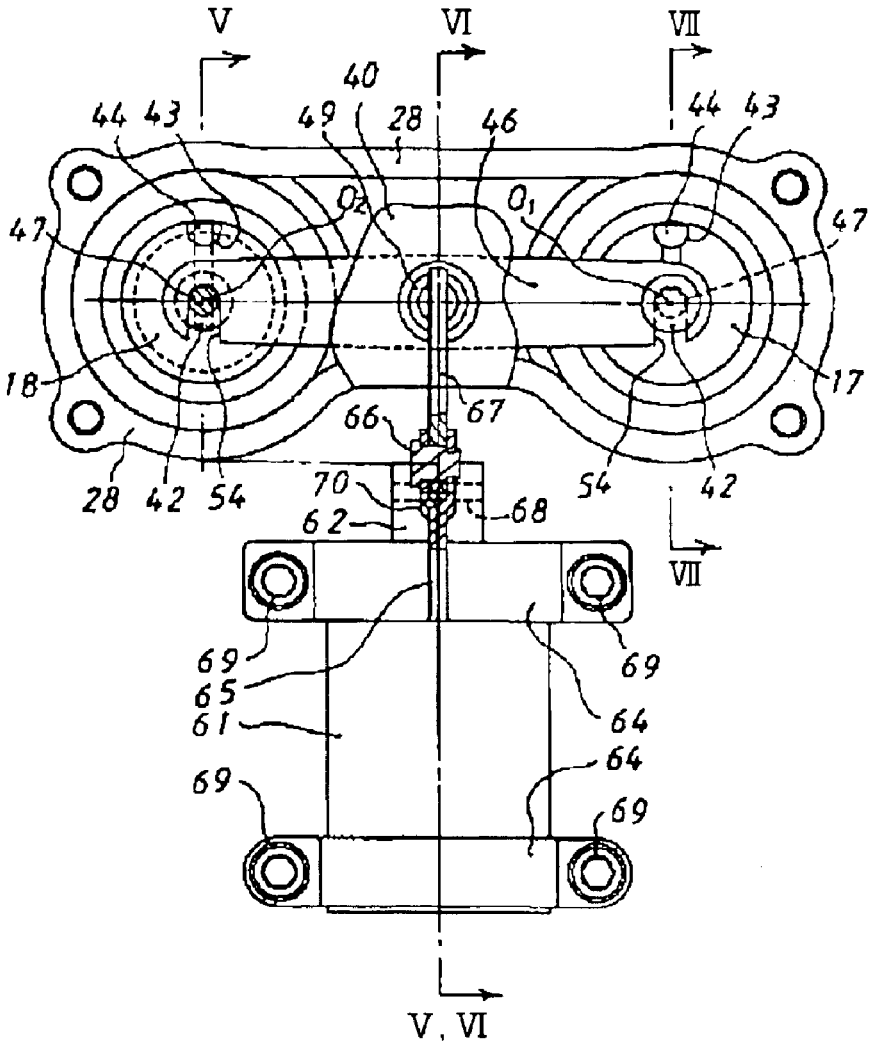
FIG. 4 is a cross-sectional view taken along the line IV—IV of FIG. 3.
Figure 7:
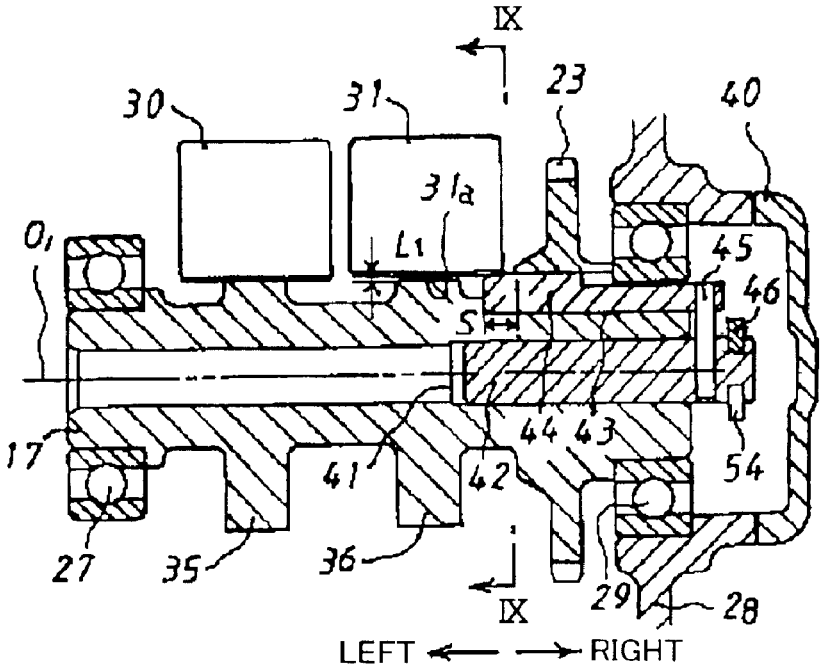
FIG. 7 is an enlarged cross-sectional view taken along the line VII—VII of FIG. 4, which shows a decompression operating state.

DECOMPRESSION DEVICE—FIG. 7 is a cross-sectional view of FIG. 4 showing the cam shaft 17 for the first cylinder 1. A guide rod 42 with a circular cross-section is fitted movably into a shaft-center bore 41, which is formed in the cam shaft 17, in the cam shaft direction. A linear groove 43 is formed in the cam shaft direction on an outer periphery of the cam shaft 17. A push-up rod 44 which serves as an push-up member for decompression is fitted in the groove 43, also movably in the cam shaft direction. Both the rods 42 and 44 protrude rightwardly from a right end face of the cam shaft 17, and the protruding ends of the rods are connected to each other through a connecting pin 45, which is arranged perpendicular to the cam shaft direction. Therefore, the rods are integrally movable in the shaft direction.

Figure 8:
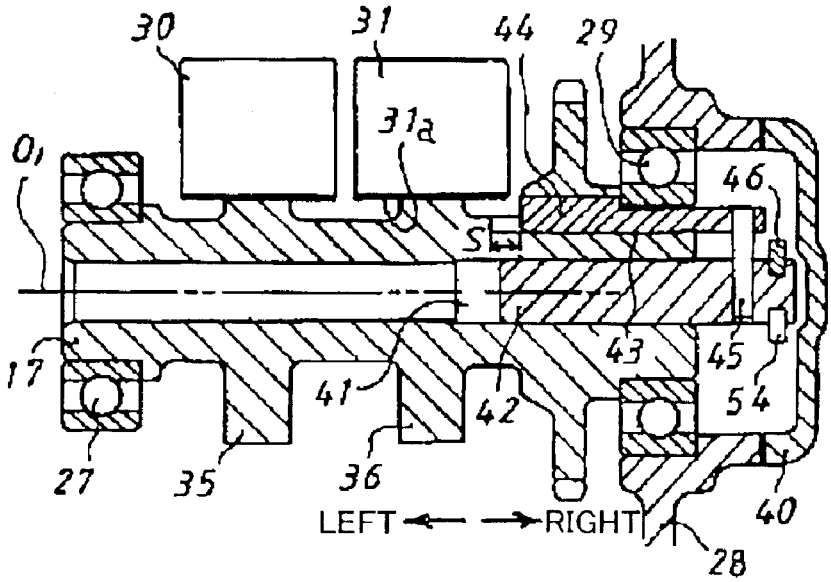
FIG. 8 is an enlarged cross-sectional view taken along the line VIII—VIII of FIG. 4, which shows a decompression non-operating state.

The push-up rod 44 is movable in the cam shaft direction by a stroke "S", between a decompression operating position, at which a left end portion of the push-up rod 44 is inserted into a width-wise range of bottom face 31*a* of the exhaust-side tappet 31 as shown in FIG. 7 and a decompression non-operating position, at which the left end portion of the push-up rod 44 is left from the range of the bottom face as shown in FIG. 8. About a one-third portion on the left-hand side of the push-up rod 44 is formed in a circular shape in cross-section, and a two-thirds portion on the right-hand side of the push-rod 44 is formed in a cut-off circular shape such that the cross-section does not interfere with bearing 29.

Figure 9:
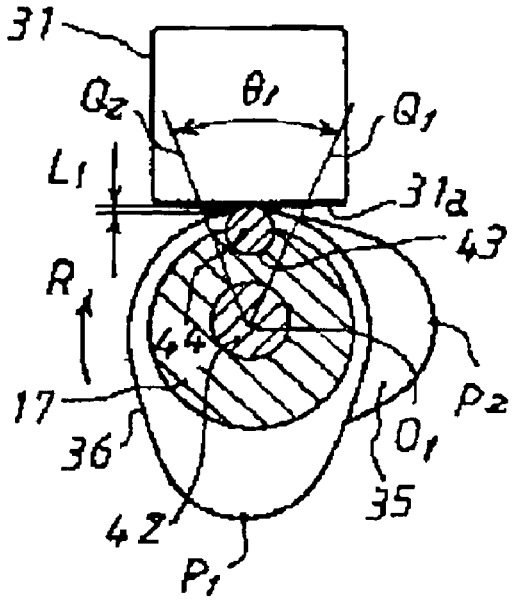
FIG. 9 is a cross-sectional view taken along the line IX—IX of FIG. 7.

FIG. 9 is a cross-sectional view taken along the line IX—IX of FIG. 7. The groove 43 and the push-up rod 44 are arranged at least within a range in the circumference direction of the cam shaft corresponding to a compression stage of the engine. In this embodiment, they are provided on the base face at approximately 180 degrees from a cam top portion $P_1$ of the exhaust-side cam face 36 and protrude outwardly in the radial direction of the cam shaft by a predetermined distance $L_1$ with respect to the base face of the cam face 36. The protruding distance $L_1$ is, for example, approximately 0.5–1.0 mm. $Q_1$ indicates a starting position of the decompression operation, and $Q_2$ indicates a terminating position of the decompression operation. One decompression operation is performed within the rotational angle range denoted by "$\theta_1$."

In general, the cam top portion $P_1$ of the exhaust-side cam face 36 is positioned approximately 90 degrees off a cam top portion $P_2$ of the intake-side cam face 35 backward in the rotational direction R of the cam shaft 17.

Returning to FIG. 3, the cam shaft 18 for the second cylinder 2 includes the same structure as the cam shaft 17 for the first cylinder 1, and it includes the push-up rod 44, which is movable in the cam shaft direction and the guide rod 42 provided in its shaft-center portion movably in the cam shaft direction, and both the rods 42 and 43 are connected by the connecting pin 45, as mentioned earlier.

Annular grooves 47 are formed around the right end portion of both the guide rods 42 for the first and second cylinders. A transmitting lever 46 extending between both the guide rods 42 engages these annular grooves 47. A transmitting rod 49 engages the middle portion of the transmitting lever 46 in the width direction. The transmitting rod 49 also engages a return spring 50, which is typically a coil spring and biases the transmitting lever 46 and the transmitting rod 49 to the right in the shaft direction. The return spring 50 is arranged inside a spring-receiving concave portion 52 formed in the cam shaft supporting case 28. The transmitting rod 49 extends to the right in the cam shaft direction and is supported movably in the cam shaft direction by a boss portion 40*a* formed in the cam shaft cover 40. A seal 53 is fitted between the boss portion 40*a* and the transmitting rod 49.

FIG. 4 is a cross-sectional view taken along the line IV—IV of FIG. 3. Notches 54, typically formed in a reverse "U" shape, are formed in the front and rear-end portions of the transmitting lever 46, respectively. These reverse U-shaped notches 54 are fitted in each of the annular grooves 47 formed on both of the guide rods 42. Thus, each of the guide rods 42 integrally moves in the cam shaft direction with the transmitting lever 46, and can be rotated on cam shaft centers $O_1$ and $O_2$ with respect to the transmitting lever 46. That is, the guide rods 42 can rotate on the cam shaft centers together with the cam shafts 17 and 18.

Figure 10:
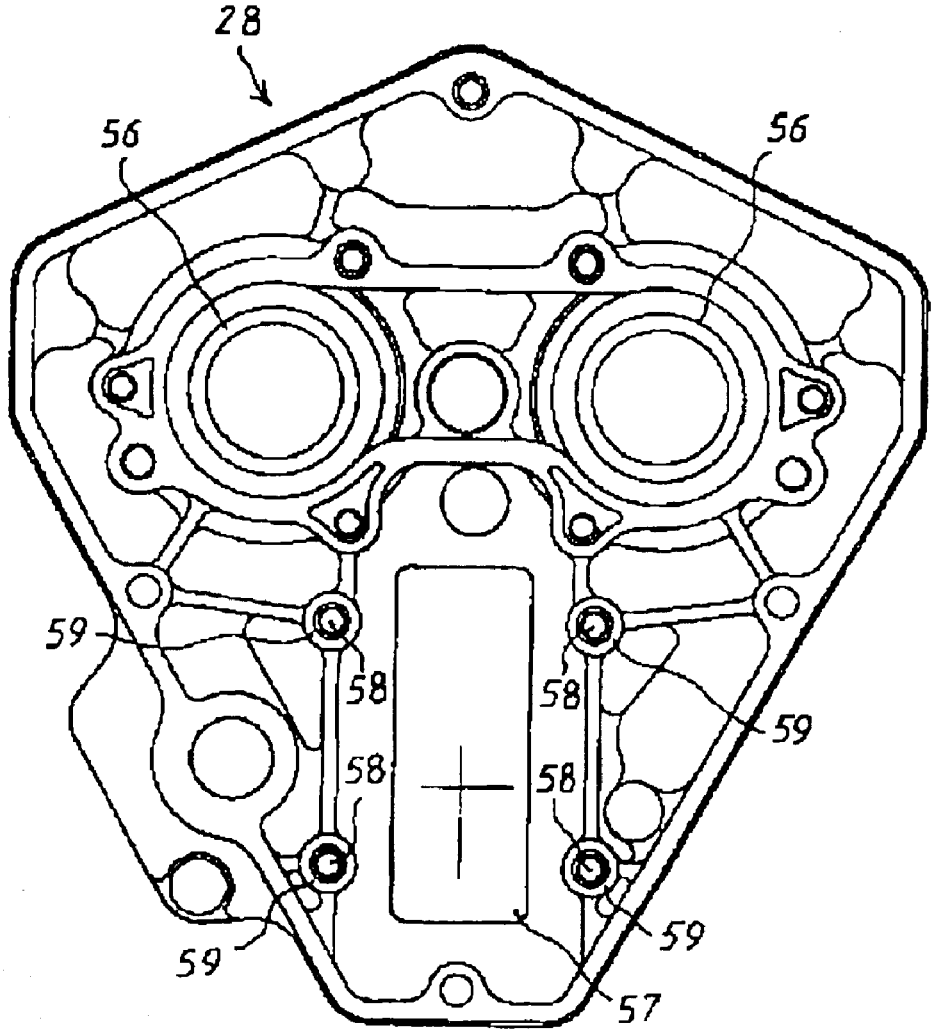
FIG. 10 is a right-side view of a cam shaft supporting case shown in FIG. 3.

FIG. 10 is a right side view of the cam shaft supporting case 28. In a lower-half portion of the cam shaft supporting case 28, a solenoid attachment seat 57 is formed at a middle corresponding to a position between front and rear cam shaft support holes 56. The attachment seat 57 is formed in a rectangular shape elongated in the vertical direction, and is provided with a plurality of (for example, four) attachment boss portions 59, each having a threaded bore 58.

Figure 5:
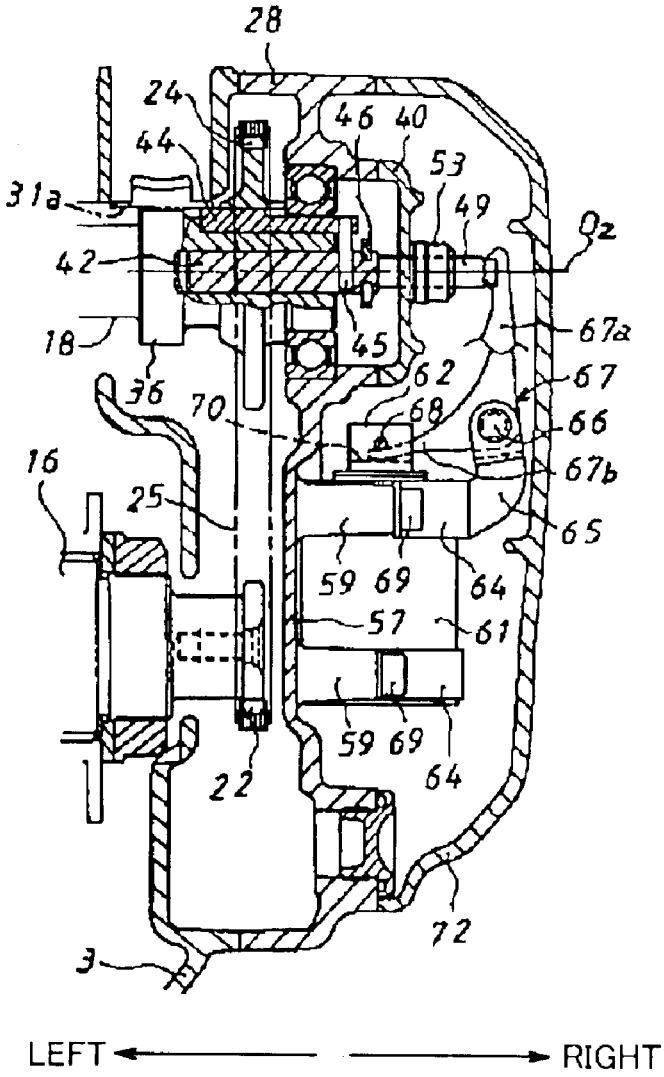
FIG. 5 is a cross-sectional view taken along the line V—V of FIG. 4.

FIG. 5 is a cross-sectional view taken along the line V—V of FIG. 4. An electromagnetically operated solenoid 61, as an actuator, is attached to the solenoid attachment seat 57 formed in the cam shaft supporting case 28. The solenoid 61 includes a movable iron core 62 (i.e. a moving rod), which is arranged perpendicularly to the cam shaft direction and extends upwardly. The solenoid 61 is fastened to the attachment seat 57 by a pair of upper and lower fasteners 64, each of which is fixed to the attachment boss portions 59 with bolts 69.

A lever holder 65 is fixed with the upper fastener 64 to the boss portions 59, and an L-shaped bell crank 67 is rotatably supported by the lever holder 65 through a support pin 66. The bell crank 67 includes a first arm portion 67*a* extending upwardly and a second arm portion 67*b* extending toward the movable iron core 62 (i.e., to the left) typically in parallel with the cam shaft center $O_2$, and both arm portions are integrally formed. An upper end of the first arm portion 67*a* is engaged with the right end face of the transmitting rod 49, and a tip portion of the second arm portion 67*b* is engaged with the engaging pin 68 provided in an upper end portion of the movable iron core 62.

The upper end portion of the movable iron core 62 is divided into two portions of front and rear by an expanding slit 70 formed in the upper end portion. The engaging pin 68 is arranged in the front-and rear direction so as to cross the expanding slit 70 perpendicularly between the two portions of the movable iron core 62, and the second arm portion 67*b* of the bell crank 67 is inserted in the expanding slit 70.

A solenoid cover 72 for covering the solenoid 61, the bell crank 67, and the cam shaft cover 40 is fastened to the right end face of the cam shaft supporting case 28.

Figure 6:
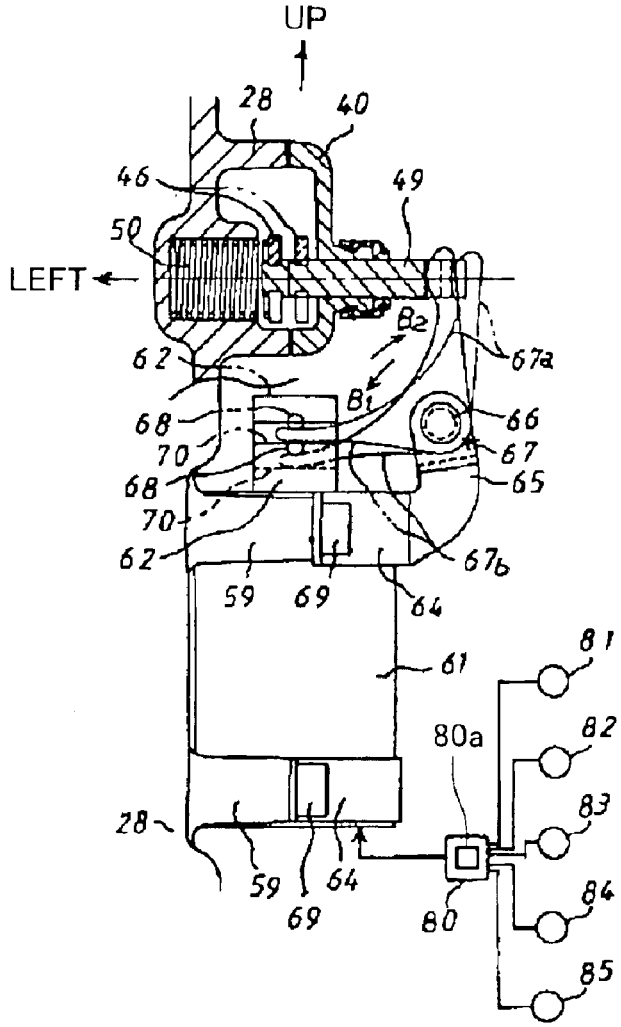
FIG. 6 is a cross-sectional view taken along the line VI—VI of FIG. 4.

FUNCTION OF SOLENOID—In FIG. 6, when the solenoid 61 is "ON" (i.e., when power is supplied), the movable iron core 62 withdraws downwardly as shown with solid lines and thus it rotates the bell crank 67 in an arrow $B_1$ direction through the engaging pin 68. By rotating the bell crank 67 in the arrow $B_1$ direction, the transmitting rod 49 and the transmitting lever 46 are pushed to the left while resisting a spring force of the return spring 50. Then both the guide rods 42 and both of the push-up rods 44 shown in FIG. 3 are pushed into a decompression operating position on the left.

On the other hand, when the solenoid 61 is "OFF" (i.e., when power is not supplied), the movable iron core 62 projects upwardly as shown with phantom lines and, thus, it rotates the bell crank 67 in an arrow $B_2$ direction by pushing the bell crank 67 with a bottom face of the expanding slit 70 and cancels the pushing force on the transmitting rod 49. The transmitting rod 49 and the transmitting lever 46 then returns to the right by the spring force of the return spring 50 and, thus, both the guide rods 42 and both the push-up rods 44 shown in FIG. 3 are returned to the decompression non-operating position on the right.

CONTROLLING SOLENOID—In FIG. 6, the solenoid 61 is connected to a controller 80 to perform ON/OFF control according to various conditions. The controller 80 is also connected to an engine speed detector 81 and a setting-adjusting unit 82 for adjusting a decompression operating engine speed. Alternatively, a manual switch 83 for turning ON and OFF at will the solenoid 61, a vehicle speed sensor 84, or a deceleration detector 85 may be connected to the controller 80 in addition to the engine speed detector 81 and the setting adjusting unit 82.

Figure 11:
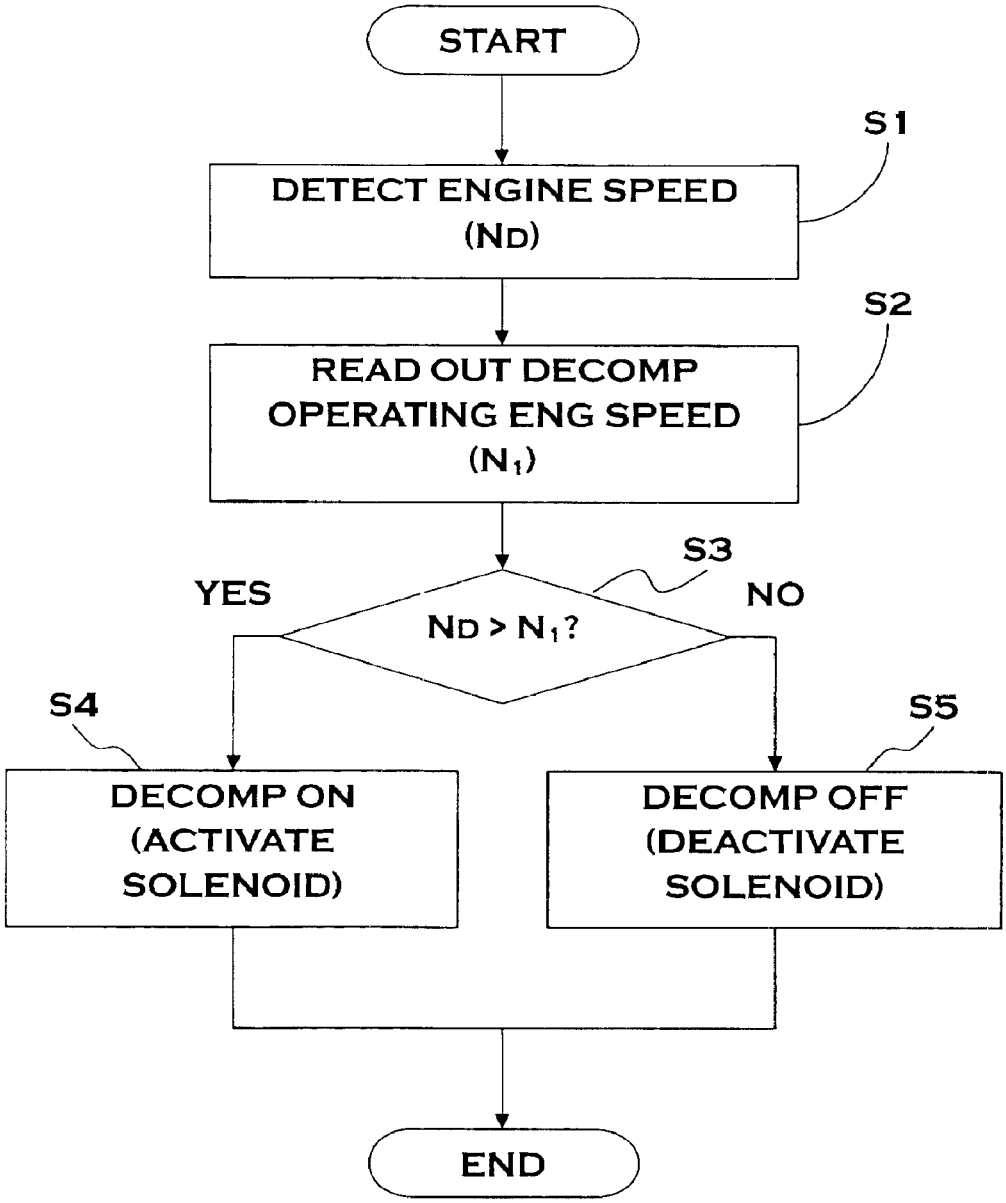
FIG. 11 is a flowchart showing a decompression control operation by a controller of FIG. 6.

The decompression operating engine speed $N_1$ can be set at a desirable value by the setting-adjusting unit 82, and the set value is stored in a memory 80*a* built inside the controller 80. As shown in a flowchart of FIG. 11, the controller 80 causes the solenoid 61 to be "ON" when an engine speed $N_D$ detected by the engine speed detector 81 is lower than the set decompression operating engine speed $N_1$, or causes the solenoid 61 to be "OFF" when the engine speed ND is higher than the decompression operating engine speed $N_1$ (Steps S1–S5).

Typically, the decompression operating engine speed $N_1$ is lower than an idling engine speed and is higher than an engine speed caused by a starter motor when starting the engine, to improve in starting performance of the engine.

OPERATION AT THE TIME OF STARTING ENGINE—At the time of starting the engine by the starter, since the engine speed $N_D$ detected by the engine speed detector 81 is lower than the decompression operating engine speed $N_1$, the solenoid 61 is in an "ON state", in which the solenoid 61 withdraws downwardly as shown with solid lines in FIG. 6, and both the guide rods 42 and both the push-up rods 44 shown in FIG. 3 are moved to the decompression operating position on the left, through the bell crank 67, the transmitting rod 49, and the transmitting lever 46.

Then, at the compression stage, the exhaust-side tappet 31 is lifted by a predetermined distance $L_1$ with respect to the base face of the cam face 36 by the push-up rod 44 as shown in FIG. 7, and then each of the exhaust valves 9 is opened through the exhaust-side push rods 21 and the exhaust-side locker arms 12 shown in FIG. 2. Thus, the compression pressure inside the cylinders is released.

OPERATION AT PRACTICAL ENGINE SPEED—As the engine is started and begins self-rotation, in turn, an engine speed will reach a practical engine speed. During this practical engine speed, which is an engine speed from idling to fully loaded condition, since the engine speed exceeds the decompression operating engine speed $N_1$, the solenoid 61 projects upwardly as shown with phantom lines in FIG. 6 to be in an "OFF state" and, thus, rotates the bell crank 67 in the arrow $B_2$ direction, and then cancels the pushing force over the transmitting rod 49.

Accordingly, the transmitting rod 49 and the transmitting lever 46 are returned to the right by the spring force of the return spring 50 and, at the same time, both the guide rods 42 and both the push-up rods 44 are moved to the decompression non-operating position on the right. Therefore, the decompression is terminated.

Then, as shown in FIG. 8, the push-up rod 44 and the exhaust-side tappet 31 do not engage each other even at the compression stage and, thus, decompression is not performed, either.

(1) The structure of utilizing the slide-type push-up rod 44 as illustrated in this embodiment may also be applicable to multi-cylinder internal combustion engines or single-cylinder internal combustion engines, other than the V-twin internal combustion engines also illustrated here.

(2) In the present invention, the actuator for driving the push-up rods 44 is not limited to the solenoid 61, but a rotary motor, a linear motor, or a hydraulic cylinder, and so on, may also be utilized as the actuator.

(3) In the above mentioned embodiment, although the push-up rod 44 with a circular cross-section is used as the push-up member, a push-up member having a plate-shape may also be utilized.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A decompression device of an internal combustion engine, comprising:

a push-up member disposed on a circumference of a cam shaft of a valve system of the internal combustion engine, within a range in a circumferential direction corresponding to a compression stage of the engine, wherein the push-up member protrudes outwardly in the radial direction of the cam shaft more than a base face of an exhaust-side cam face formed on the cam shaft, and the push-up member is movably supported in a cam shaft direction; and a drive mechanism for moving the push-up member between a decompression operating position, at which the push-up member is inserted in a width-wise range of a bottom face of an exhaust-side tappet of the valve system, which comes in contact with the exhaust-side cam face and a decompression non-operating position, at which the push-up member is retreated from the width-wise range;

wherein the drive mechanism includes:

a guide rod fitted into a shaft-center bore formed along a shaft center of the cam shaft so as to be movable in the cam shaft direction; and a connecting member for connecting the guide rod and the push-up member so as to be integrally movable; and wherein the push-up member is moved in the cam shaft direction through the connecting member by moving the guide rod.

2. The decompression device of claim 1, wherein the drive mechanism includes an actuator interlocked with the guide rod to move the push-up member.

3. The decompression device of claim 2, wherein the internal combustion engine includes a plurality of cylinders, and the cam shaft of each of the cylinders is provided with the guide rod and the push-up member, respectively; and wherein the actuator is interlocked with each of the guide, rods to move each of the push-up members to decompress the plurality of cylinders, respectively.

4. The decompression device of claim 2, wherein the actuator is a linear actuator, and is arranged so that an output shaft thereof crosses the cam shaft at right angles.

5. The decompression device of claim 2, wherein the actuator is a solenoid.

6. The decompression device of claim 5, wherein the actuator is arranged so that a movable iron core thereof crosses the cam shaft at right angles.

7. The decompression device of claim 3, wherein the drive mechanism further includes a biasing means for biasing the push-up member to the decompression non-operating position, and wherein the actuator moves the push-up member to the decompression operating position while resisting to a biasing force of the biasing means when the actuator is activated, and the biasing means moves the push-up member to the decompression non-operating position when the actuator is not activated.

8. A decompression device of an internal combustion engine, comprising:

a push-up member disposed on a circumference of a cam shaft of a valve system of the internal combustion engine, within a range in a circumferential direction corresponding to a compression stage of the engine, wherein the push-up member protrudes outwardly in the radial direction of the cam shaft more than a base face of an exhaust-side cam face formed on the cam shaft, and the push-up member is movably supported in a cam shaft direction; and a drive mechanism for moving the push-up member between a decompression operating position, at which the push-up member is inserted in a width-wise range of a bottom face of an exhaust-side tappet of the valve system, which comes in contact with the exhaust-side cam face, and a decompression non-operating position, at which the push-up member is retreated from the width-wise range;

wherein the drive mechanism includes:

an engine speed detector for detecting an engine speed of the engine;

a memory for storing a decompression operating engine speed; and a controller for moving the push-up member to the decompression operating position when the engine speed detected by the engine speed detector is lower than the decompression operating engine speed stored in the memory, and moving the push-up member to the decompression non-operating position when the engine speed detected by the engine speed detector is higher than the decompression operating engine speed stored in the memory.

9. The decompression device of claim 8, wherein the drive mechanism further includes a setting adjusting unit for adjusting a set value of the decompression operating engine speed stored in the memory.

10. The decompression device of claim 1, wherein the drive mechanism is provided on one said of the cam shaft.

11. The decompression device of claim 8, wherein the drive mechanism is provided on one end side of the cam shaft.

* * * * *